United States Patent [19]

Wickline et al.

[11] 4,418,609

[45] Dec. 6, 1983

[54] WELL PUMPING SYSTEM

[75] Inventors: Richard A. Wickline, Mansfield; Richard Y. Wickline, Fort Worth, both of Tex.

[73] Assignee: Wickline, Saginaw, Tex.

[21] Appl. No.: 244,239

[22] Filed: Mar. 16, 1981

[51] Int. Cl.[3] ..... F01L 25/08; F15B 11/08

[52] U.S. Cl. ..... 91/275; 91/218; 91/443; 92/137; 74/110

[58] Field of Search ..... 92/137; 91/275, 277, 91/279, 443; 74/89.22, 110

[56] References Cited

U.S. PATENT DOCUMENTS

| | | | |
|---|---|---|---|
| 2,268,945 | 1/1942 | Kelly | 74/110 |
| 2,681,623 | 6/1954 | Kane | 92/137 |
| 2,683,424 | 7/1954 | Kane | 92/137 |
| 3,077,838 | 2/1963 | Maglott | 91/375 X |
| 3,439,815 | 4/1969 | Wagner et al. | 74/89.22 X |
| 3,643,432 | 2/1972 | Klager | 91/275 X |
| 3,782,117 | 1/1974 | James | 92/137 |

FOREIGN PATENT DOCUMENTS

| | | | |
|---|---|---|---|
| 2709386 | 9/1977 | Fed. Rep. of Germany | 91/443 |

*Primary Examiner*—Robert E. Garrett

*Assistant Examiner*—Abram McConnell Bradley, IV

*Attorney, Agent, or Firm*—Hubbard, Thurman, Turner & Tucker

[57] ABSTRACT

A pumping unit for actuating a linear reciprocable pump rod comprises a frame having a pair of spaced apart vertical guides for guiding vertical reciprocating movement of a traveling pulley assembly connected to a linear extensible hydraulic cylinder mounted on the frame directly under the pulley assembly. The pulley assembly includes two rotatable sheaves over which are trained, respectively, flexible cables which are anchored at their opposite ends to the frame and to a bracket connected to the pump rod. The arrangement provides a single purchase pulley system providing for a pump rod stroke length of twice the stroke length of the cylinder actuator. A hydraulic control system for reciprocating the cylinder includes a solenoid operated valve which is controlled by a cam actuated switch to alternately provide for conducting hydraulic fluid to and from the cylinder. The valve actuating switches are tripped by spaced apart cams mounted on a rod connected to the pulley assembly. The position of the cams on the actuating rod may be adjusted to vary the stroke length of the cylinder actuator.

14 Claims, 7 Drawing Figures

WELL PUMPING SYSTEM

BACKGROUND OF THE INVENTION

1. Field of the Invention

This invention pertains to a well pumping unit including a hydraulic linear actuator for imparting vertical reciprocating movement to a pair of cable sheaves around which pump rod lift cables are trained and anchored at their respective opposite ends to the pump rod and the pumping unit frame.

2. Background Art

In the art of oil well pumping units there has been a continuing need for compact and mechanically uncomplicated equipment which may be easily transported to and from the well site and which is sufficiently reliable to permit automatic unattended operation for long periods of time. The most widely accepted type of well pumping equipment for some time has been the traditional rocking or walking beam type unit which, although somewhat reliable, is relatively heavy and mechanically complicated, requiring considerable mechanical linkage and relatively moving parts which require lubrication.

Moreover, heretofore known types of well pumping equipment have lacked the flexibility for adjustment of the length of the pump stroke of the well pumping mechanism. There has been an increasing need for well pumping units which may be readily adjusted to vary the length of stroke of the polished rod and the sucker rod pump mechanism connected thereto. The increased pumping of partially depleted fields and fields having deposits of relatively heavy crude oil has resulted in a substantial need for equipment which provides a relatively long sucker rod actuating stroke and which also is readily adjustable to vary the stroke length in accordance with the pumping requirements of a particular well.

Another problem in the art of well pumping equipment pertains to the overall reliability of the pumping unit. The increasing reliability of hydraulic power supply systems has made it desirable to pursue the development of well pumping equipment which may utilize hydraulic system components for the development of compact and efficient pump actuating mechanisms. The further need for increased reliability of well pumping units requires that the mechanism be mechanically uncomplicated and have a minimum number of components which require periodic lubrication.

The above noted requirements in the art of well pump actuating equipment have been heretofore difficult to meet while at the same time providing a unit which is compact, lightweight and easily transported to and from the well site as well as being adapted for easy servicing of the well and the pump actuating mechanism itself.

SUMMARY OF THE INVENTION

The present invention provides an improved well pumping unit which has a unique and superior actuating mechanism for actuating the linear reciprocable pump rod of a sucker rod type well pump. In accordance with the present invention there is provided a compact and lightweight pumping unit utilizing a linear extensible hydraulic actuator for providing linear reciprocating movement of the polished rod of a well pump through an arrangement of cables trained over a traveling pulley mechanism connected to one end of the lift actuator.

The arrangement of a hydraulic cylinder and piston for providing the lift stroke of a sucker rod well pump mechanism in combination with a superior pulley and cable mechanism for interconnecting the hydraulic cylinder with the linear reciprocable pump rod provides for a compact and reliable well pumping unit. Moreover, by utilizing a hydraulic cylinder actuator as the pumping unit actuating mechanism heavy and cumbersome mechanical components such as rocking beams and the associated counterweights and gear type speed reduction equipment may be replaced by the hydraulic cylinder and a compact hydraulic power supply unit.

The well pumping unit of the present invention also provides for improved mechanism which is easily adapted for varying the stroke length of the pump rod over a wide range of strokes and in a substantially continuously variable range of strokes within the limits of the actuating mechanism and its associated control system. In accordance with the present invention there is provided a superior control system for actuating a linearly extensible hydraulic cylinder over a wide range of stroke lengths with an easily adjusted and reliable stroke control mechanism. The improved stroke control mechanism of the present invention includes a linearly reciprocable control rod having spaced apart cams for engaging cam actuated switches to operate a hydraulic control valve for valving pressure fluid to and from the hydraulic cylinder. The control mechanism is conveniently mounted in an enclosure which is isolated from the operating environment of the pump unit and is adapted to provide lubrication of the switch actuating mechanism. A further advantageous aspect of the control system in accordance with the present invention resides in its overall simplicity and the use of conventional pressure fluid control system components.

Another important aspect of the present invention pertains to the improved mechanism for providing a relatively long stroke length, which mechanism is compact and mechanically uncomplicated. The present invention utilizes a unique traveling pulley system connected to one end of a linear reciprocating hydraulic actuator and guided for linear reciprocating movement to increase the travel of a set of flexible cables. The cables are trained over a pair of spaced apart rotating sheaves of the pulley system and are anchored at their respective opposite ends to a pump rod carrier on one side of the sheaves and to the pumping unit frame on the other side of the sheaves. By utilizing the increased stroke length of the pulley and cable system of the present invention the overall height of the pulley support and guide assembly is reduced and provides for a compact pumping unit. Moreover, the mechanically uncomplicated mechanism requires a minimum of maintenance and essentially only two points of lubrication are required for the entire pump actuating mechanism.

A still further advantageous aspect of the present invention resides in the supporting structure for the pump rod actuating mechanism which is adaptable to be easily moved from a working position to a retracted position to permit servicing operations to be performed at the wellhead. The arrangement of the actuating mechanism support structure also provides for easy access to the pump actuating mechanism for servicing or replacement of the hydraulic cylinder actuator, if needed.

As will be appreciated by those skilled in the art of well pumping units the present invention provides for a unique pump actuating mechanism which is compact, mechanically uncomplicated, reliable in operation and easily adjusted for varying the stroke length of the reciprocable pump rod. The advantages of the present invention and the superior features thereof will be further appreciated upon reading the detailed description which follows in conjunction with the drawings.

BRIEF DESCRIPTION OF THE DRAWINGS

FIG. 8 is a detail perspective view of the pivot connection of the vertical frame to the base frame.

DESCRIPTION OF THE PREFERRED EMBODIMENT

Figure 1:
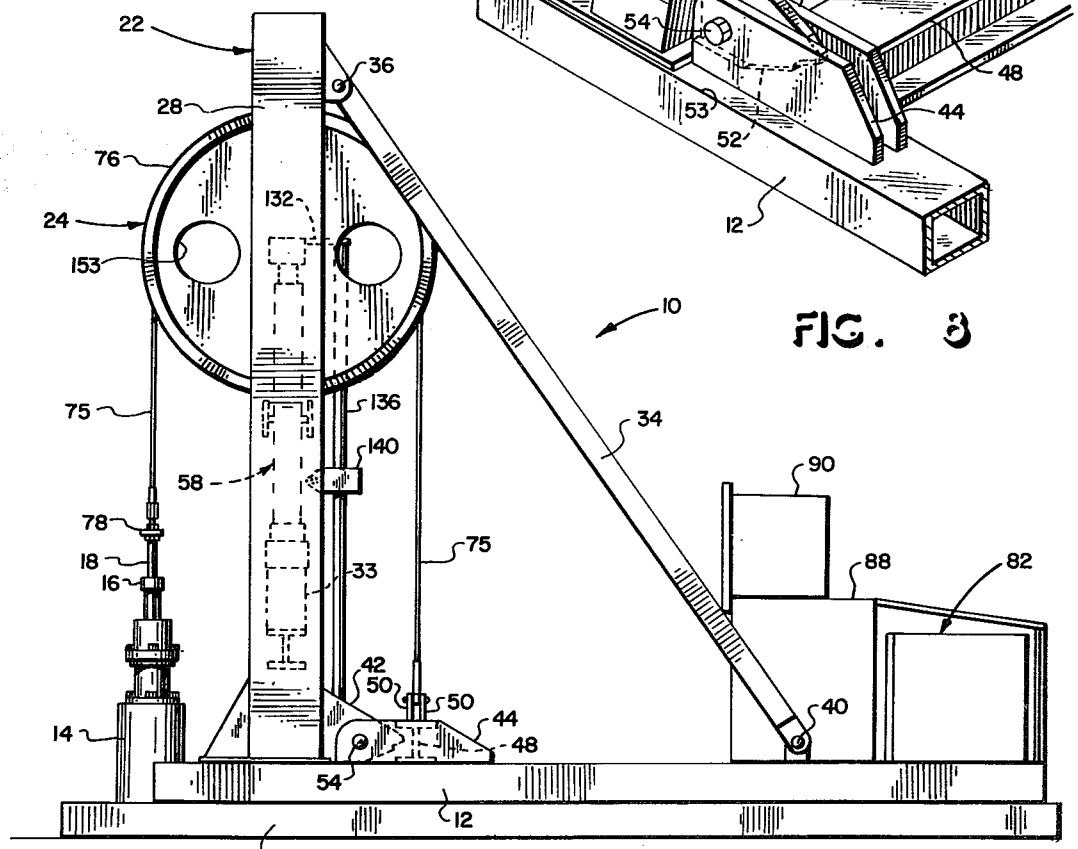
FIG. 1 is a longitudinal side elevation of the pumping unit of the present invention.
Figure 2:
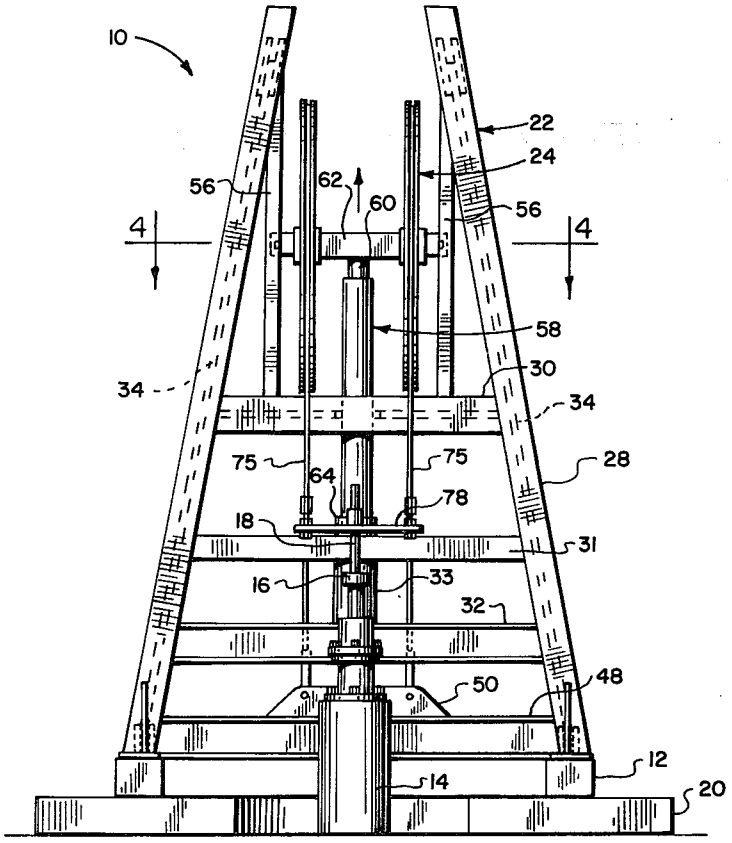
FIG. 2 is an end elevation of the pumping unit shown in FIG. 1.
Figure 3:
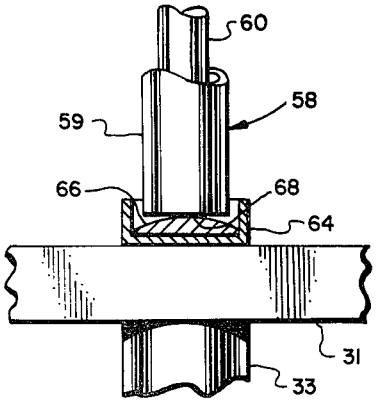

Referring to FIGS. 1 and 2 of the drawing, the present invention comprises an improved well pumping unit generally designated by the numeral 10. The pumping unit 10 includes a base frame portion 12 adapted to be positioned in proximity to a wellhead, generally designated by the numeral 14. The wellhead 14 may be of a conventional type having a stuffing box 16 and a linear reciprocable pump rod 18 known in the art as the polished rod of a sucker rod type well pumping mechanism, not shown. The pumping unit 10 is adapted to reciprocate the polished rod through a selected range of linear strokes in accordance with the requirements of the well system. The base portion 12 may be mounted on a concrete pad 20 poured next to the wellhead 14 or some other suitable support means. In certain situations the base portion 12 may be merely positioned on the ground surface next to the wellhead and anchored by suitable rod anchors or the like, not shown, driven into the ground. However, a conventional mounting arrangement would include a more stable supporting structure under the base portion 12 such as the pad 20.

The pumping unit 10 includes a substantially vertically disposed frame portion, generally designated by the numeral 22, for supporting a traveling pulley mechanism 24 for vertical reciprocating movement with respect to the frame 22. The frame 22 comprises a pair of spaced apart generally upstanding beam members 26 and 28 which are interconnected by cross beam members 30, 31 and 32, as shown in FIG. 2. The frame members 26 and 28 converge toward each other at their upper ends, respectively. The frame 22 is mounted on the base 12 for limited pivotal movement about a horizontal axis as will be described in further detail herein. The frame 22 is secured in the position shown in FIGS. 1 and 2 by a pair of struts 34, one shown in FIG. 1, which are pivotally connected to the frame 22 at the respective upper ends of the members 26 and 28 by pivot pins 36. The struts 34 are also suitably pivotally connected to the base portion 12 by pivot pins 40 which may be removed so that the struts may be lifted clear of the base portion to permit pivotal movement of the frame 22 away from the wellhead. The frame members 26, 28, 30, 31 and 32 may be made of a combination of several types of conventional structural steel elements such as I beams or channels suitably welded together into a unitary structure.

Referring to FIG. 8 there is illustrated a detail of one of the pivotal connections between the lower ends of the frame members 26 and 28 and the base portion 12. By way of illustration, the lower end of the frame member 28 includes a laterally projecting plate member 42 which is disposed between spaced apart brackets 44 and 45 mounted on the base 12 and suitably fastened thereto such as by welding. The brackets 44 and 45 may be part of a frame substructure secured to the base 12 and including a transverse beam member 48 which supports a pair of spaced apart upstanding bracket members 50, partially shown in FIG. 8. The plate 42 includes a lower angled edge portion 52 and a suitable bore through which a pivot pin 54 projects and is journalled by the spaced apart bracket members 44 and 45. The frame member 26 also includes a plate member 42 disposed on its lower side in the same manner as the frame member 28. Accordingly, the frame 22 is pivotally mounted on the base portion 12 and may be pivoted away from the longitudinal axis of the polished rod 18 upon disconnecting the struts 34 at either their pivot points 36 or 40, and reclining the frame 22 until the edges 52 of the brackets 42 engage the upper surface 53 of the base portion 12.

Referring again to FIG. 2, the frame 22 includes a pair of spaced apart vertically disposed channel members 56 having their respective flanges facing each other. The channel members 56 comprise vertical guideways for the pulley assembly 24 to permit reciprocation of the pulley assembly under the urging of a linear extensive hydraulic actuator generally designated by the numeral 58. The actuator 58 comprises a hydraulic cylinder and piston assembly extending vertically upward through a suitable opening in member 30 and having a piston rod 60 connected to a support member comprising a crossbar 62 of the pulley assembly.

Figure 3:
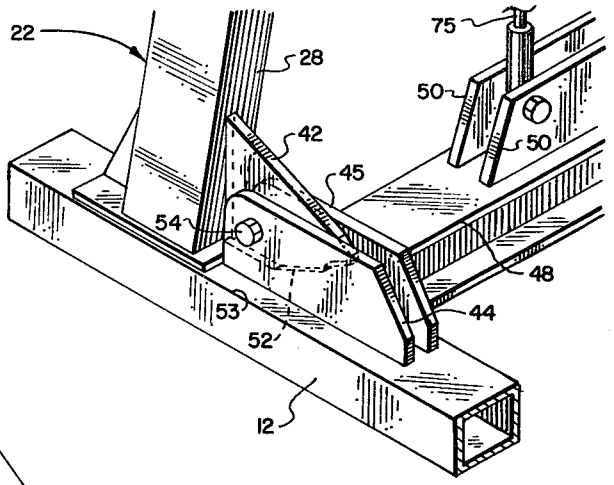
FIG. 3 is a detail view illustrating the support socket for the hydraulic cylinder actuator of the pumping unit illustrated in FIGS. 1 and 2.

Referring to FIG. 3, the lower end of the cylinder 59 of the actuator 58 is disposed in a socket member 64 which is mounted on the crossbeam member 31 and also supported by a member 33 interconnecting the beams 31 and 32. The socket member 64 includes a substantially upward facing spherical surface portion 66 adapted to support the lower end of the cylinder member 59 of the actuator 58. The cylinder 59 includes a substantially flat bottom surface 68 engaged with the surface portion 66 to provide for limited omnidirectional movement of the actuator 58 with respect to the frame 22.

Figure 5:
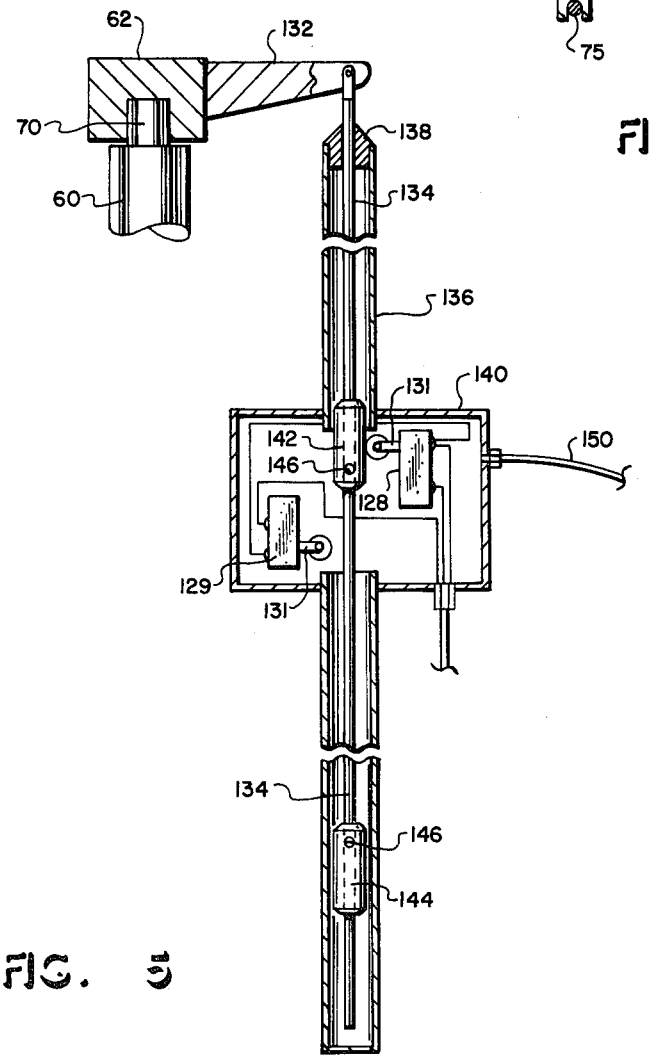
FIG. 5 is a vertical elevation in section illustrating the control mechanism for actuating the control circuit to reciprocate the hydraulic cylinder actuator.

As will be appreciated by those skilled in the art the actuator 58 is operable to lift the pulley assembly 24 vertically upward with respect to the frame 22 and wherein the pulley assembly is guided for substantially vertical linear reciprocation by the guide channels 56. Referring to FIGS. 2 and 5, the crossbar 62 of the pulley assembly 24 includes a recess for receiving a reduced diameter portion 70 of the distal end of the piston rod 60 in snug fitting but releasable relationship thereto. Accordingly, the pulley assembly 24 may be easily disconnected from the actuator 58 by lifting it off of the end of the piston rod 60.

Figure 4:
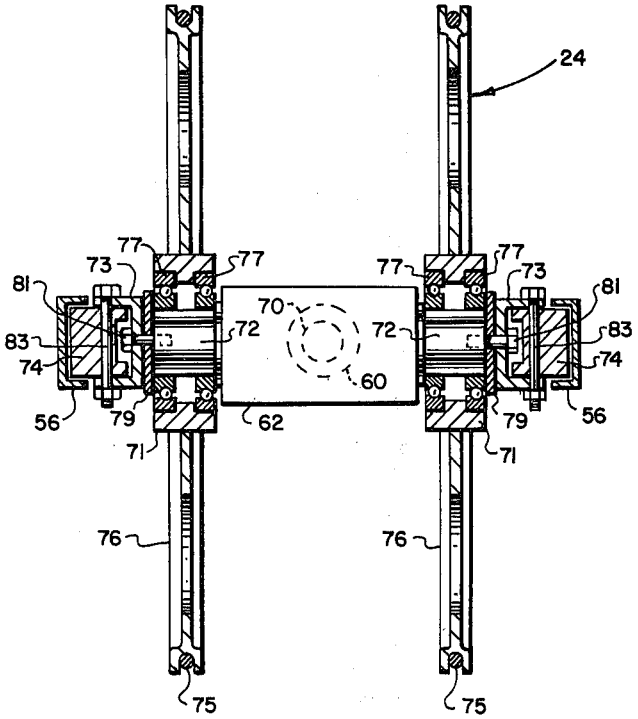
FIG. 4 is a section view taken substantially from the line 4—4 of FIG. 2.

Referring particularly to FIG. 4, the crossbar 62 includes oppositely projecting shaft portions 72 on which are mounted sets of ball bearings 77 which are preferably sealed or shielded and which are mounted in hub portions 71 of a pair of spaced apart rotatable cable sheaves 76. The sheaves 76 are retained on the crossbar 62 by end plates 79 secured to the crossbar by bolts 81 which also retain oppositely projecting clevises 73, as shown in FIG. 4. The clevises 73 are connected to guide blocks 74 by respective bolts 83 to facilitate easy assembly and disassembly of the blocks with respect to the crossbar 62. The guide blocks 74 are slidably disposed in the respective guide members 56 as shown. In order to minimize the lubrication requirements of the pumping unit 10 the guide channels 56 are preferably made of stainless steel and the guide blocks 74 are preferably made of a substantially self-lubricating bronze. The sheaves 76 are adapted to have a pair of spaced apart flexible steel cables 75 trained thereover and anchored at their respective opposite ends to a bracket 78 and to the bracket members 50 mounted on the base member 48. As shown in FIGS. 1 and 2, the bracket 78 is suitably connected to the polished rod 18 in a conventional manner.

From the foregoing description it will be appreciated that energization of the cylinder actuator 58 to extend the piston rod 60 vertically upward will cause the pulley assembly 24 to move vertically upward to draw the cables 75, bracket 78 and the polished rod 18 also vertically upward. Thanks to the arrangement of the pulley assembly 24 and the single purchase reaving of the cables 75 thereover, the polished rod 18 will traverse a linear distance equal to twice the linear distance of movement of the piston rod 60 and the pulley assembly 24. Accordingly, the arrangement of the present invention provides for a compact pump rod actuating mechanism which provides for travel of the pump rod over a linear distance greater than the actuating mechanism itself. It will be appreciated by those skilled in the art that the rotatable sheaves 76 could be replaced by fixed guide shoes or the like mounted on the crossbar 62 while still obtaining the two for one linear movement of the pump rod with respect to the cylinder actuator 58. However, the rotating sheaves 76 provide, of course, for less wear on the cables 75 and also reduce the frictional losses associated with operation of the pump unit 10.

Referring again to FIG. 1, the actuator 58 is provided with pressure fluid from a suitable hydraulic power supply unit mounted on the pumping unit 10 and generally designated by the numeral 82. The power supply unit 82 includes a prime mover such as an electric motor 84 drivably connected to a hydraulic pump 86, not shown in FIG. 1, but represented schematically in FIG. 6. The power supply unit is adapted to receive hydraulic fluid from a reservoir 88 mounted adjacent to the power supply unit 82 on the base portion 12. The power supply unit 82 also includes an air cooled heat exchanger 90 for cooling the hydraulic oil circulating through the hydraulic system of the pumping unit. Accordingly, the pump 86 is adapted to supply pressure fluid to the actuator 58 to effect reciprocation of the actuator and the pulley assembly through an upstroke under pressure supplied from the pressure side of the pump 86. Moreover, by means of a suitable control valve, a controlled release of hydraulic fluid from the cylinder 58 on the same side of the piston may be effected to control the retraction or down stroke of the pulley assembly and the polished rod 18.

Figure 6:
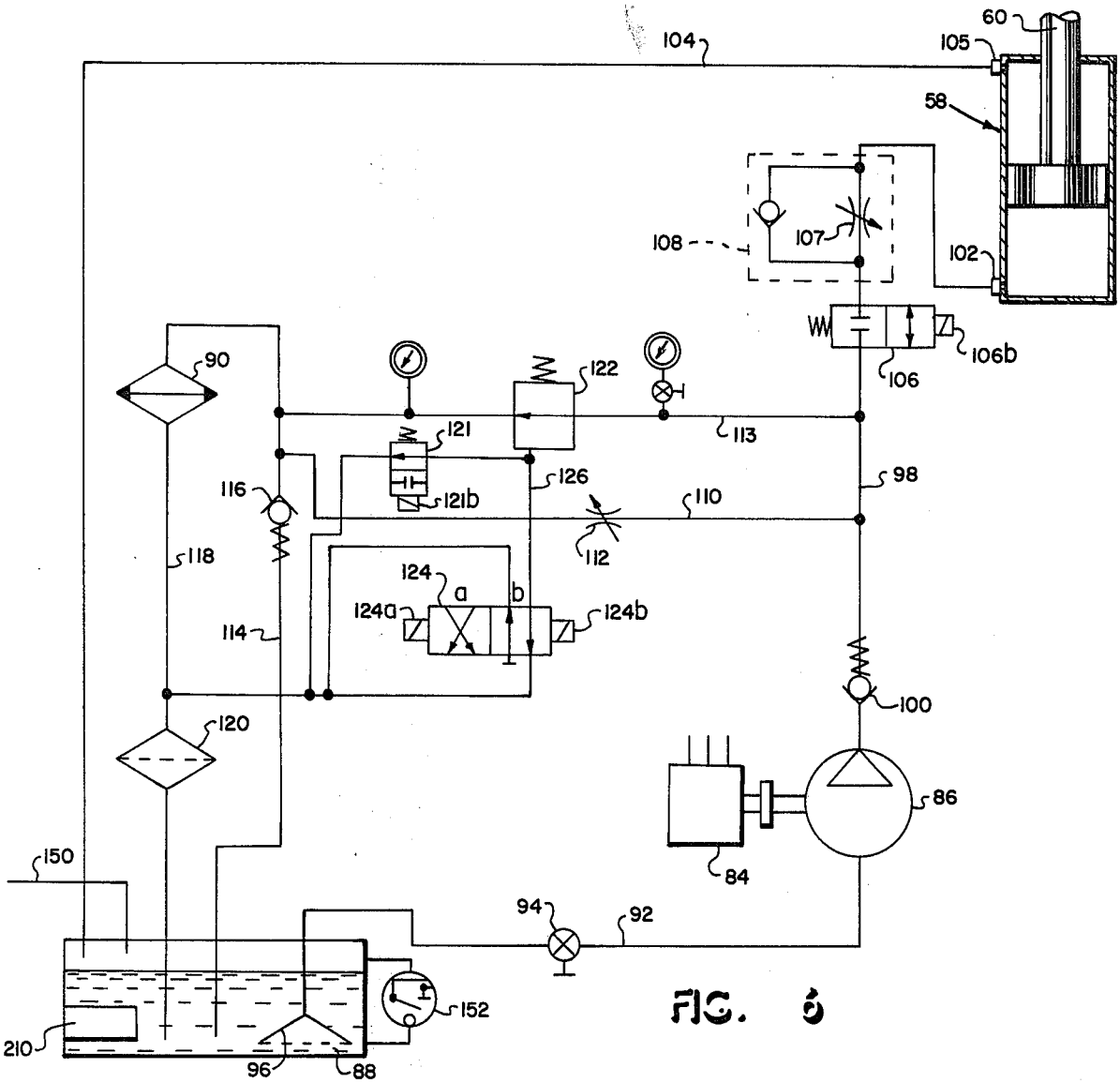
FIG. 6 is a schematic diagram of the hydraulic control system for the pumping unit of the present invention.
Figure 7:
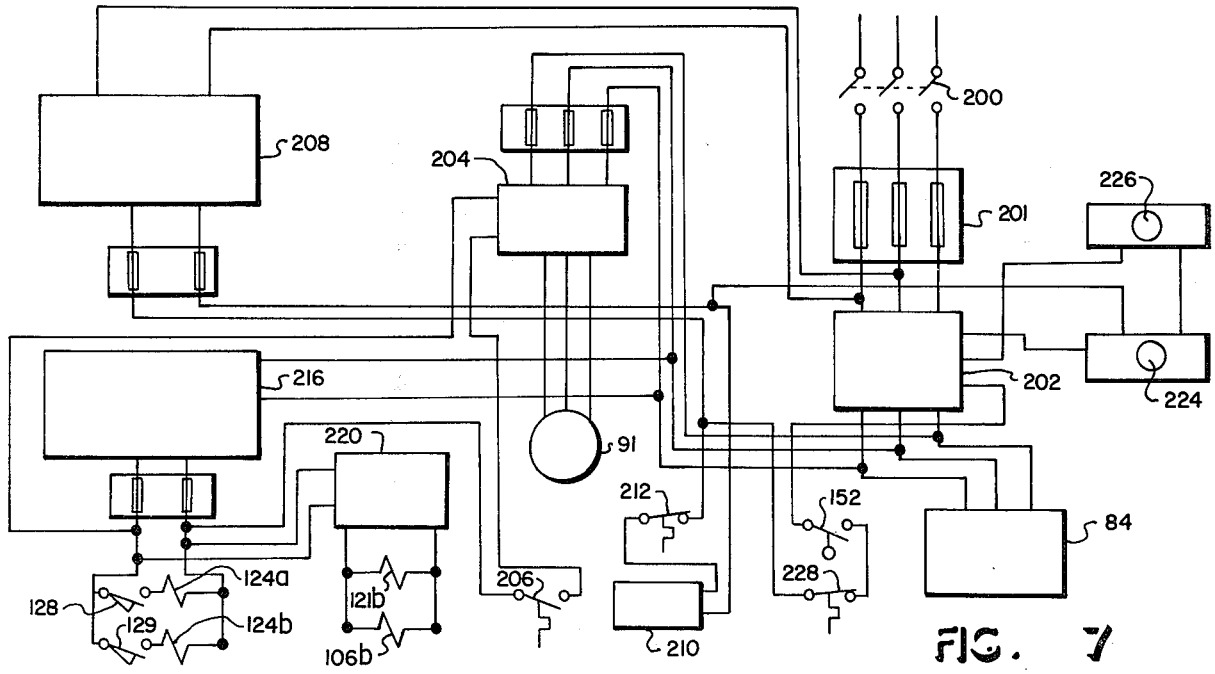
FIG. 7 is a schematic diagram of an electrical control circuit for the control system of the present invention.

FIGS. 6 and 7 illustrate a schematic diagram of a control system for operating the pumping unit 10. Referring particularly to FIG. 6, the control system includes the motor 84, and the pump 86 which is adapted to receive pressure fluid from the reservoir tank 88 by way of a suction flow line 92 having a manual shutoff valve 94 interposed therein between the tank and the pump. The suction line 92 also preferably includes a filter 96 for filtering hydraulic fluid before it enters the pump 86. The control system illustrated in FIG. 6 includes a pump discharge line 98 having a check valve 100 disposed therein downstream of the pump discharge port. The discharge line 98 leads to a fluid inlet port 102 of the cylinder 59 to provide hydraulic fluid to extend the piston rod 60 to lift the pulley assembly 24. The cylinder actuator 58 may be a double acting type cylinder, in which case, a conduit 104 is connected between the other inlet port 105 of the cylinder and the reservoir tank 88 to allow oil mist vapor to circulate in and out of the cylinder to lubricate the side wall thereof as well as the piston and rod seals.

The control system for the pumping unit 10 further includes a normally closed solenoid actuated valve 106 interposed in the discharge line 98 and a one way flow control valve 108 to provide for controlling the rate of flow of pressure fluid out of the cylinder 59 through the port 102. The control system still further includes a bypass line 110 having an adjustable flow control valve 112 disposed therein and connected to a return line 114. The return line 114 is in communication with the fluid reservoir 88 and also includes a pressure relief valve 116 which provides for the normal return flow of fluid bypassed from the pump 86 to be conducted through the heat exchanger 90 by way of a secondary return line 118 which is also connected to a return line filter 120.

The control system illustrated in FIG. 6 further includes an adjustable pressure relief valve 122 in communication with the pump discharge line 98 and with the return line 114 by way of a bypass line 113. The pressure relief valve 122 includes a bypass port which connects line 113 directly with a normally open solenoid actuated valve 123 and a two position solenoid actuated valve 124 by way of a bypass line 126. The solenoid actuated valve 124 is adapted to be actuated to move between stable positions a and b, indicated in FIG. 6, by cam actuated switches 128 and 129. The switches 128 and 129 are operable to be actuated by mechanism to be described in further detail herein to effect the switching of pressure fluid in the control system to cause the actuator 58 to reciprocate the pulley assembly 24. When the valve 124 is in the position b indicated in the schematic diagram of FIG. 6 fluid discharged by the pump 86 and from the cylinder 59 is vented through the bypass lines 113 and 126 directly back to the return line 118 to permit the piston rod 60 of the actuator 58 to retract to lower the pump rod 18. The retraction rate of the piston rod 60 is controlled by the adjustable flow control valve 108 which restricts the flow of fluid out of the cylinder 59 and through the conduits 98 and 113. When the control valve 124 is in position a the line 126 is blocked and the pressure relief valve 122 will open only in response to a substantial pressure greater than the normal working pressure of the cylinder actuator 58. Accordingly, by switching the position of the valve 124 between positions a and b the actuator 58 is operated to reciprocate in opposite directions to effect linear reciprocation of the pulley assembly 24 and the pump rod 18. The valve 121 is operable to be energized to close when valve 106 is open.

Referring now to FIG. 5 of the drawings, there is illustrated an actuating mechanism for controlling the stroke length of the cylinder actuator 58 and the piston rod 18. As shown in FIGS. 1 and 5 the crossbar 62 includes a laterally projecting arm 132 which is suitably pivotally connected to one end of an elongated rod 134. The rod 134 extends generally vertically through a guide bushing 138 and within an elongated tubular member 136. The member 136 includes an enlarged housing portion 140 in which the switches 128 and 129 are disposed so that respective actuating levers 131 of the switches may be engaged by a pair of spaced apart cams 142 and 144 mounted on the rod 134 and slidably disposed within the tubular member 136 in close fitting relationship thereto. The cams 142 and 144 are adapted to be adjustably positioned on the rod 134 by suitable means such as respective set screws 146. By suitably positioning the cams 142 and 144 on the rod 134 the stroke length of the cylinder actuator 58 may be controlled by engagement of the actuating levers 131 of the switches 128 and 129 to effect movement of the valve 124 to position a and position b, respectively. The valve 124 is of the type which remains in the position to which it was moved by one of the solenoid actuators until the other actuator is energized.

The interior of the tubular member 136 including the enlarged housing portion 140 is suitably isolated from the exterior environment by the close fitting relationship of the bushing 138 to the rod 134. The housing portion 140 of the enclosure is in communication with the hydraulic fluid reservoir 88 by way of a conduit 150 so that hydraulic oil vapor may be circulated into and out of the interior of the enclosure formed by the member 136 and housing portion 140 as the rod 134 reciprocates with the pulley assembly 24. Accordingly, an oil mist is circulated through the aforementioned enclosure to lubricate the cams and the switch operating levers and to prevent the inflow of atmospheric air and moisture from the exterior environment of the pumping unit 10.

Referring also to FIG. 7 of the drawings an electrical circuit diagram for the control system of the pumping unit of the present invention is illustrated. The control system for the pumping unit 10 includes a source of three phase electrical power, not shown, connected to a main switch 200 which is suitably connected to a motor starter 202 by way of conventional in-line fuses, generally designated by the numeral 201. The main leads from the motor starter 202 are connected to the pump motor 84 in a conventional manner. The control circuit of FIG. 7 further includes fused leads connected to a fan motor 91 for the cooler 90 by way of a motor relay 204. The relay 204 is adapted to be in a closed condition when a temperature responsive switch 206 is closed to start the motor 91 thereby operating the oil cooler 90 to control the maximum temperature of the oil in the hydraulic system. The temperature switch 206 is suitably located in the reservoir 88 or in the flow path of hydraulic fluid such as the line 92 and is operable to energize the motor 91 when the hydraulic fluid temperature reaches a predetermined limit, preferably 150° F., for example.

The control system of the present invention further includes a transformer 208 connected in circuit with the motor leads as shown and operable to reduce the main line voltage to a suitable level for use in a heater 210 adapted to be disposed in the reservoir 88 and controlled by a thermostatic switch 212 to maintain a minimum oil temperature in the reservoir and in the system, preferably between 100° and 120° F. The control circuit further includes a transformer 216 connected to the motor leads leading from the starter 202 and adapted to supply a reduced voltage signal to a circuit including switch 206, the cam actuated switches 128 and 129 and the respective solenoids **124*a* and 124*b*. The control transformer 216 also supplies electrical energy to a time delay relay 220 in circuit with solenoids 106*b* and 121*b* for the respective solenoid operated valves 106 and 121**.

The control circuit includes conventional motor start and stop switches 224 and 226 as illustrated in FIG. 7 which are adapted to operate suitable motor starting relays to energize and de-energize the motor 84 in a known way. The circuit including the motor start button 224 also includes the low oil level switch 152 and a temperature limit switch 228 which are adapted to either prevent starting of the motor 84 or to de-energize the motor if the hydraulic fluid level in the reservoir 88 drops below a predetermined minimum or if the temperature of the fluid in the reservoir or the line 92 exceeds a predetermined maximum.

In the operation of the pumping unit 10, assuming that the fluid level in the reservoir is adequate and the temperature of the fluid has not exceeded a predetermined maximum, the motor 84 may be energized to drive the pump 86 to supply hydraulic fluid to the line 98. On starting of the motor 84 electrical energy is also supplied by way of transformer 216 to the time delay relay 220. However, the solenoids **106*b* and 121*b* are not energized until a suitable time delay of approximately 10 seconds has passed upon starting of the motor. This delay in energization of the solenoids for the respective valves 106 and 121 provides for bypass of fluid discharged by the pump 86 through the line 113 and line 126 directly back to the reservoir 88 as will be appreciated from viewing the circuit illustrated in FIG. 6. After expiration of the delay period set by the relay 220 the solenoids 106*b* and 121*b* are energized to close the valve 121 and open valve 106 whereby hydraulic fluid may be supplied to the actuator 59, depending on the position of valve 124. If the valve 124 is in position b, fluid from the discharge line 98 will flow through the bypass line 113 and the return lines 126 and 118 back to the reservoir 88. With the pressure in the line 98 reduced to a negligible value, hydraulic fluid will also flow out of the cylinder 59 and through the flow control valve 108 to the bypass return line 113 along with fluid being bypassed by the pump 86 back to tank. The weight of the pulley assembly 24 and also the substantial weight of the pump rod 18 and its associated mechanism will cause the cylinder actuator 58 to retract rather rapidly. However, the rate of retraction of the actuator 58 is controlled by the flow control valve 108 since the flow of fluid in the reverse direction through the line 98 must pass through the variable orifice 107 which is a part of the flow control valve. The rate of flow out of the cylinder 59 may, of course, be controlled by adjusting the flow control orifice 107**.

When the actuator 58 has retracted sufficiently to cause the cam 142 to actuate the switch 128, solenoid **124*a* is momentarily energized and the valve 124 is moved to position a to block the flow of fluid out of line 113 by way of line 126. Accordingly, hydraulic fluid being discharged by the pump 86 will cause the actuator 58 to extend the piston rod 60 to raise the pulley assembly and the polished rod 18. The rate of upstroke of the piston rod 60 may be controlled by adjustment of the variable orifice flow control valve 112 which operates to bypass a controlled amount of pressure fluid being discharged by the pump 86. As the rod 134 moves upward with the pulley assembly 24, the cam 144 will engage the lever of switch 129 to energize the solenoid 124*b* to effect movement of the valve 124 to its position b. In position b of the valve 124, pressure fluid will again be bypassed from the discharge line 98 through lines 113, 126 and 118, and the cycle of the cylinder actuator will repeat the operation described above under the control of the circuit illustrated in FIGS. 6 and 7**.

As will be appreciated from the foregoing description, the position of the cams 142 and 144 may be adjusted on the rod 134 to effect control of the length of stroke of the lift cylinder actuator 58 and, accordingly, the length of stroke of the pump rod 18. It will also be appreciated that not only may the total stroke length of the pump rod 18 be varied but the upper and lower stroke limits of the pump rod may also be adjusted in accordance with the positioning of the cams 142 and 144. Accordingly, within the maximum stroke limits of the pump rod 18 or the pumping unit 10, the stroke length as well as the position of the limits of the stroke of the pump rod may be substantially infinitely varied.

It will be understood that the control valves 106 and 121 are adapted to be de-energized if for any reason electrical power to the pumping unit is interrupted or if the motor 84 is shut down for any reason. When the valve 106 is de-energized, it moves to the closed position to block the flow of hydraulic fluid out of the cylinder 59 to prevent completion of the down stroke of the pumping unit 10 and the pump rod 18. Without the supply of hydraulic fluid from the pump 86 and without the normal operation of the control circuit, the considerable weight of the pump rod 18 and the sucker rod pumping mechanism connected thereto would cause a fairly rapid down stroking of the cylinder actuator 58 which could result in damage to the pumping unit and the well pumping equipment without the provision of the valve 106.

The pumping unit 10 is also particularly well adapted to provide easy access to the wellhead for well servicing operations, as needed, without requiring movement of the entire pumping unit away from the wellhead itself. By merely disconnecting the struts 34 at their pivot pins 40, for example, the frame 22 may be tilted about the pivot pins 54 to move the pulley assembly 24 and the cables 75 away from the longitudinal axis of the well to enable well servicing equipment to be placed in position without the need to move the entire pumping unit 10 away from the wellhead. The arrangement whereby the pulley assembly 24 and the cylinder actuator 58 are mounted fairly close to the pivot axis of the pins 54 in regard to the vertical direction permits relatively easy movement of the frame 22 to be tilted about its pivot axis and this normally may be accomplished by one operator. Thanks to the location of the surface 52 on the brackets 42, the frame 22 will be prevented from tilting far enough to preclude easy movement of the frame in the opposite direction back into its working position.

If, for any reason, if it necessary to service the cylinder actuator 58 or interchange the actuator with a new one such may be easily accomplished with the arrangement of the pumping unit 10 by extending the piston rod 60 until the pulley assembly 24 is raised sufficiently to permit insertion of a holding bar, not shown, through suitable holes 153 in the respective sheaves 76 and then lowering the pulley assembly until the bar is bridging the upper ends of the upstanding beam members 26 and 28. The cylinder actuator 58 may then be easily removed by disconnecting the hydraulic fluid lines 98 and 104 and by retracting the piston rod 60 to disengage from the cross bar 62.

From the foregoing description those skilled in the art of well pumping equipment will appreciate that the present invention comprises a unique combination of elements which provide for a well pumping unit which is compact, mechanically uncomplicated, reliable in operation and adapted to operate with a relatively wide range of pump stroke lengths. The pumping unit 10 is particularly adapted for long periods of unattended operation and minimum maintenance. The bearings 77 are the only points on the unit which may require even relatively infrequent periodic lubrication. The generous proportions of the sheaves 76 also reduce the stresses on the cables interconnecting the pumping unit with the pump rod 18. Moreover, the mounting arrangement of the cylinder actuator 58 is such that essentially no side loads are exerted on the piston rod 60 thereby eliminating cyclic beam deflection of the rod and also minimizing the wearing effect on the piston and rod sealing elements.

Although a preferred embodiment of the present invention has been described in detail herein those skilled in the art will recognize that variations and modifications to the features of the pumping unit and its associated control system may be made without departing from the scope and spirit of the invention recited in the appended claims.

What we claim is:

1. A pumping unit for actuating a linear reciprocable pump rod extending from a wellhead, said pumping unit comprising:

a frame including an elongated horizontally extending base portion and a vertically extending portion mounted on said base portion, said vertically extending portion comprising a single pair of opposed spaced apart vertically extending beam members interconnected by at least one generally horizontal transverse crossbeam member at a point below the upper ends of said vertically extending beam members, two opposed guide members supported on said vertically extending beam members, respectively, and extending substantially vertically and parallel to each other;

a single travelling pulley assembly including a crossbar and a pair of sheaves rotatably mounted on said crossbar, a pair of opposed bearings supported on opposite ends of said crossbar and adapted to be engaged by said guide members, respectively, and above said crossbeam member for linear reciprocating movement along said vertically extending portion of said frame;

a linear extensible hydraulic cylinder and piston assembly supported at one end on said frame and connected at its opposite end to said pulley assembly;

a pair of flexible cable means anchored at one end to said frame, said flexible cable means being trained over said sheaves, respectively, and secured to said pump rod for linear reciprocation of said pump rod in response to actuation of said cylinder and piston assembly to move said pulley assembly vertically in said guide members through a clear path of reciprocation between said vertically extending beam members whereby said pulley assembly may be at least partly extended above the upper ends of said vertically extending beam members during reciprocation by said cylinder and piston assembly, and said pulley assembly may be inserted in and removed from between said vertically extending beam members from said upper ends of said vertically extending beam members, respectively.

2. The pumping unit set forth in claim 1 wherein:

said crossbeam member includes means for supporting said one end of said cylinder and piston assembly for limited omnidirectional pivotal movement with respect to said crossbeam member to minimize lateral loading and deflection on said cylinder and piston assembly during reciprocation of said pulley assembly.

3. The pumping unit set forth in claim 2 wherein:

said means for supporting said one end of said cylinder and piston assembly includes a pedestal forming a socket having a spherical bearing surface for supporting a cooperating surface on said cylinder and piston assembly.

4. The pumping unit set forth in claim 1 wherein:

said guide members comprise a pair of opposed channel members facing each other, and said bearings on said pulley assembly comprise a pair of bearing blocks adapted to be slidably disposed in said channel members, respectively.

5. The pumping unit set forth in claim 4 wherein:

said crossbar includes opposed portions for rotatably supporting respective ones of said pair of sheaves thereon, and said bearing blocks are each removably secured to said crossbar by first threaded bolt means securing each of said bearing blocks to a clevis member secured to one end of said crossbar.

6. The pumping unit set forth in claim 5 wherein:

said clevis members are secured to said crossbar by second threaded bolt means whereby said bearing blocks are pivotable about mutually perpendicular pivot axes formed by said first and second bolt means and with respect to said channel members.

7. The pumping unit set forth in claim 5 wherein:

said bearing blocks are mounted between opposed arms of said clevis means and said bearing blocks may be removed from said crossbar by removing said first bolt means from said clevis means and sliding said bearing blocks vertically in said channel members.

8. A pumping unit for actuating a linear reciprocable pump rod extending from a wellhead, said pumping unit comprising:

a frame including an elongated horizontal base portion and a vertically extending portion supported on said base portion;

said vertically extending portion comprising a single pair of opposed vertically extending beam members spaced apart from each other and supported at their lower ends on said base portion, at least one crossbeam member interconnecting said vertically extending beam members at a point below the upper distal ends of said vertically extending beam members;

a pair of opposed vertically extending guide members supported by said vertically extending beam members and forming a guideway between said vertically extending beam members for a travelling pulley assembly, said pulley assembly comprising a crossbar rotatably supporting sheave means, and said pulley assembly including bearing means adapted to be engaged with said guide channels for vertical reciprocating movement in said guideway between said vertically extending beam members;

a linear extensible hydraulic cylinder and piston assembly supported at one end on said crossbeam member and having a piston rod connected at its distal end to said pulley assembly for reciprocating said pulley assembly through said guideway;

flexible cable means anchored at one end to said frame, said flexible cable means being trained over said sheave means and secured to said pump rod for linear reciprocation of said pump rod in response to actuation of said cylinder and piston assembly; and means forming a socket on said crossbeam member and including a spherical bearing surface adapted to support the lower end of the cylinder of said cylinder and piston assembly to permit limited omnidirectional movement of said cylinder and piston assembly with respect to said crossbeam member to minimize lateral deflection of said piston rod.

9. A pumping unit for actuating a linear reciprocable pump rod extending from a wellhead, said pumping unit comprising:

a frame including an elongated horizontal base portion and a vertically extending portion supported on said base portion;

said vertically extending portion comprising a single pair of opposed vertically extending beam members spaced apart from each other and supported at their lower ends on said base portion, at least one crossbeam member interconnecting said vertically extending beam members at a point below the upper distal ends of said vertically extending beam members;

a pair of opposed vertically extending guide members supported by said vertically extending beam members and forming a guideway between said vertically extending beam members for a travelling pulley assembly, said pulley assembly including rotatable sheave means and including means adapted to be engaged with said guide members for vertical reciprocating movement in said guideway between said vertically extending beam members;

a linear extensible hydraulic cylinder and piston assembly supported at one end on said frame and connected at its opposite end to said pulley assembly for reciprocating said pulley assembly through said guideway;

flexible cable means anchored at one end to said frame, said flexible cable means being trained over said sheave means and secured to said pump rod for linear reciprocation of said pump rod in response to actuation of said cylinder and piston assembly; and each of said vertically extending beam members including a laterally projecting portion at the base end thereof including means for pivotally mounting said vertically extending frame portion on said base portion by pivot pin means secured to said base portion, said laterally projecting portions being engageable with said base portion to support said vertically extending frame portion in a partially reclined position between a vertical position and a horizontal position with respect to said base portion to provide clearance between said pump rod and said pulley assembly for access to said pump rod without moving said base portion of said frame away from said wellhead.

10. The pumping unit set forth in claim 9 together with:

a pair of struts spaced apart on said frame and pivotally connected to said vertically extending portion and said base portion at respective opposite ends of said struts to retain said vertically extending portion in said working position, said struts being adapted to be disconnected from said base portion to permit said vertically extending frame portion to be reclined.

11. A pumping unit for actuating a linear reciprocable pump rod extending from a wellhead, said pumping unit comprising:

a frame including an elongated horizontal base portion and a vertically extending portion supported on said base portion;

said vertically extending portion including a pair of opposed vertically extending guide members forming a vertical guideway for a travelling pulley assembly, said travelling pulley assembly including means for rotatably supporting a sheave, and said travelling pulley assembly being adapted to be engaged with said guide members for vertical reciprocating movement in said guideway;

a linear extensible hydraulic cylinder and piston assembly supported at one end on said frame and connected at its opposite end to said pulley assembly for reciprocating said pulley assembly through said guideway;

flexible cable means anchored at one end to said frame, said flexible cable means being trained over said sheave and secured to said pump rod for linear reciprocation of said pump rod in response to actuation of said cylinder and piston assembly; and a laterally projecting arm operably connected to a piston rod of said cylinder and piston assembly and connected to a vertically extending actuator rod, said actuator rod extending within an elongated tubular enclosure disposed on said frame adjacent to said cylinder and piston assembly, spaced apart cam means on said actuator rod adapted to engage limit switch means in said enclosure for actuating control means to control the reciprocation of said piston rod in response to engagement of said limit switch means by said cam means.

12. The pumping unit set forth in claim 11 including:

conduit means interconnecting said enclosure with a source of pressure fluid for providing lubricant to said enclosure, said source of pressure fluid comprising a reservoir for a hydraulic power supply unit for operating said cylinder and piston assembly.

13. A pumping unit for actuating a linear reciprocable pump rod extending from a wellhead, said pumping unit comprising:

a frame including an elongated horizontal base portion and a vertically extending portion supported on said base portion;

said vertically extending portion including a pair of opposed vertically extending guide members forming a vertical guideway for a travelling pulley assembly, said pulley assembly includng means for rotatably supporting a sheave, and said pulley assembly being adapted to be engaged with said guide members for vertical reciprocating movement in said guideway;

a linear extensible hydraulic cylinder and piston assembly supported at one end on said frame and connected at its opposite end to said pulley assembly for reciprocating said pulley assembly through said guideway;

flexible cable means anchored at one end to said frame, said flexible cable means being trained over said sheave and secured to said pump rod for linear reciprocation of said pump rod in response to actuation of said cylinder and piston assembly to raise said pump rod in response to the introduction of pressure fluid to said cylinder and piston assembly and to lower said pump rod under its weight and the weight of said pulley assembly in response to exhausting pressure fluid from said cylinder and piston assembly; and a source of hydraulic pressure fluid including a pump, conduit means interconnecting said pump and said cylinder and piston assembly for supplying pressure fluid to cause said cylinder and piston assembly to lift said pump rod by said flexible cable means, a valve interconnected with said conduit means for interrupting the flow of pressure fluid from said pump to said cylinder and piston assembly, and flow control means operable to control the flow of fluid out of said cylinder and piston assembly to control the rate of lowering of said pump rod.

14. The pumping unit set forth in claim 13 including:

flow control means for bypassing a portion of the fluid discharged by said pump into said conduit means for controlling the rate of lifting of said pump rod.

* * * * *